US007884058B2

(12) United States Patent
Nelson et al.

(10) Patent No.: US 7,884,058 B2
(45) **Date of Patent: *Feb. 8, 2011**

(54) STABLE COLLOIDAL SUSPENSIONS AND LUBRICATING OIL COMPOSITIONS CONTAINING SAME

(75) Inventors: Kenneth D. Nelson, Clear Lake, CA (US); James J. Harrison, Novato, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 836 days.

This patent is subject to a terminal disclaimer.

(21) Appl. No.: 10/675,631

(22) Filed: Sep. 30, 2003

(65) Prior Publication Data

US 2005/0070445 A1 Mar. 31, 2005

(51) Int. Cl.

| | |
|---|---|
| ***B01F 17/00*** | (2006.01) |
| ***C07C 309/62*** | (2006.01) |
| ***C08G 81/02*** | (2006.01) |
| ***C10L 1/22*** | (2006.01) |
| ***C10L 1/24*** | (2006.01) |
| ***C10M 159/24*** | (2006.01) |
| ***C10M 173/02*** | (2006.01) |

(52) U.S. Cl. ..... 508/232; 508/170; 508/165; 508/233; 508/235; 508/387; 508/390; 508/391

(58) Field of Classification Search ..... 508/232, 508/233, 165, 170, 235, 387, 390, 391
See application file for complete search history.

(56) References Cited

U.S. PATENT DOCUMENTS

| | | | | |
|---|---|---|---|---|
| 3,140,997 | A | 7/1964 | Price | |
| 3,172,892 | A | 3/1965 | LeSuer et al. | |
| 3,219,666 | A | 11/1965 | Norman et al. | |
| 3,223,625 | A * | 12/1965 | Neblett et al. | 508/165 |
| 3,249,538 | A | 5/1966 | Rolf | |
| 3,272,746 | A | 9/1966 | LeSuer et al. | |
| 3,361,673 | A | 1/1968 | Stuart et al. | |
| 3,368,972 | A | 2/1968 | Otto | |
| 3,405,064 | A | 10/1968 | Miller | |
| 3,539,663 | A | 11/1970 | Pietrusza et al. | |
| 3,541,014 | A | 11/1970 | Le Suer | |
| 3,574,576 | A | 4/1971 | Honnen et al. | |
| 3,649,229 | A | 3/1972 | Otto | |
| 3,909,430 | A | 9/1975 | Hotten | |
| 3,912,764 | A | 10/1975 | Palmer, Jr. | |
| 3,968,157 | A | 7/1976 | Hotten | |
| 4,152,499 | A | 5/1979 | Boerzel et al. | |
| 4,157,309 | A | 6/1979 | Wilgus et al. | |
| 4,234,435 | A | 11/1980 | Meinhardt et al. | |
| 4,263,152 | A | 4/1981 | King et al. | |
| 4,272,387 | A | 6/1981 | King et al. | |
| 4,601,837 | A | 7/1986 | Valcho et al. | |
| 4,647,388 | A | 3/1987 | Schreiber | |
| 5,112,507 | A | 5/1992 | Harrison | |
| 5,137,978 | A | 8/1992 | Degonia et al. | |
| 5,137,980 | A | 8/1992 | DeGonia et al. | |
| 5,175,225 | A | 12/1992 | Ruhe, Jr. | |
| 5,286,799 | A | 2/1994 | Harrison et al. | |
| 5,319,030 | A | 6/1994 | Harrison et al. | |
| 5,523,417 | A | 6/1996 | Blackborow et al. | |
| 5,565,528 | A | 10/1996 | Harrison et al. | |
| 5,616,668 | A | 4/1997 | Harrison et al. | |
| 5,625,004 | A | 4/1997 | Harrison et al. | |
| 5,777,025 | A | 7/1998 | Spencer et al. | |
| 5,792,729 | A | 8/1998 | Harrison et al. | |
| 6,410,491 | B1 | 6/2002 | Harrison et al. | |
| 6,534,450 | B1 | 3/2003 | Harrison et al. | |
| 6,632,781 | B2 * | 10/2003 | Harrison et al. | 508/158 |
| 2003/0073587 | A1 | 4/2003 | Harrison et al. | |

FOREIGN PATENT DOCUMENTS

| | | |
|---|---|---|
| EP | 0 271 337 | 6/1988 |
| EP | 0 355 895 | 2/1990 |
| EP | 0 542 380 | 5/1993 |
| EP | 0 602 863 | 6/1994 |
| EP | 1 298 191 | 4/2003 |

* cited by examiner

*Primary Examiner*—Patrick D Niland
(74) *Attorney, Agent, or Firm*—Claude J. Caroli; M. Carmen & Associates PLLC

(57) ABSTRACT

A stable colloidal suspension comprising: (a) a dispersed phase comprising a major amount of one or more dispersed hydrated polymeric compounds selected from the group consisting of polymolybdates, polytungstates, polyvanadates, polyniobates, polytantalates, polyuranates, and mixtures thereof, and, (b) an oil phase comprising one or more dispersing agents and a diluent oil. Processes for preparing the stable colloidal suspensions and their use in lubricating oil compositions are also provided.

71 Claims, No Drawings

STABLE COLLOIDAL SUSPENSIONS AND LUBRICATING OIL COMPOSITIONS CONTAINING SAME

BACKGROUND OF THE INVENTION

1. Field of the Invention

The present invention generally relates to stable colloidal suspensions useful as lubricating oil additives for lubricating oil compositions.

2. Description of the Related Art

Compositions containing molybdic acid have been used as lubricating oil additives to control oxidation and wear of engine components. Since their discovery, such complexes have been widely used as engine lubricating oil additives in automotive and diesel crankcase oils and as an additive in some two-cycle oils to prevent valve sticking. Generally, these compounds are added to a dispersant inhibitor (DI) package that is then added to the engine lubricating oils.

In general, such compositions can be, for example, complexes of molybdic acid and oil soluble basic nitrogen containing compounds made with an organic solvent during a molybdenum-containing composition complexation step. The complexation step can be followed by a sulfurization step as disclosed in U.S. Pat. Nos. 4,263,152 and 4,272,387, the contents of which are incorporated herein by reference.

A problem associated with these compounds is that they are dark in color, particularly after sulfurization; the sulfurized compositions are extremely dark in color. For instance, the sulfurized compositions are measured at about 5 triple dilute (DDD) using an ASTM D1500 or ASTM D6045 colorimetric test. Since reduced color lubricating oils are highly desired in the marketplace, these dark compositions can only be used in limited amounts because of the impact they have on the finished oil color.

It would therefore be desirable to provide a lubricating oil additive which not only exhibits good frictional properties, oxidation inhibition and anti-wear performance for lubricating oil compositions but also allows for lower color of the lubricating oils.

SUMMARY OF THE INVENTION

In accordance with a first embodiment of the present invention, a stable colloidal suspension is provided comprising (a) a dispersed phase comprising a major amount of one or more dispersed hydrated polymeric compounds selected from the group consisting of polymolybdates, polytungstates, polyvanadates, polyniobates, polytantalates, polyuranates, and mixtures thereof; and, (b) an oil phase comprising one or more dispersing agents and a diluent oil.

In a preferred embodiment of the present invention, a stable colloidal suspension is provided which comprises (a) a dispersed phase comprising a major amount of a dispersed hydrated polymolybdate; and, (b) an oil phase comprising one or more dispersing agents selected from the group consisting of polyalkylene succinic anhydrides, non-nitrogen containing derivatives of a polyalkylene succinic anhydride and mixtures thereof, and a diluent oil.

In another embodiment of the present invention, a process for preparing a stable colloidal suspension is provided comprising:

mixing, under agitation, (a) an aqueous solution comprising one or more polymeric compounds selected from the group consisting of polymolybdates, polytungstates, polyvanadates, polyniobates, polytantalates, polyuranates, and mixtures thereof; (b) one or more dispersing agents; and, (c) a diluent oil to form a micro emulsion; and, heating the micro emulsion to a temperature to remove sufficient water so as to produce a stable colloidal suspension comprising (a) a dispersed phase comprising a major amount of one or more dispersed hydrated polymeric compounds selected from the group consisting of polymolybdates, polytungstates, polyvanadates, polyniobates, polytantalates, polyuranates, and mixtures thereof; and, (b) an oil phase comprising the dispersing agent and the diluent oil.

In yet another embodiment of the present invention, a process for preparing a stable colloidal suspension is provided comprising:

mixing, under agitation, (a) an aqueous solution comprising (i) one or more monomeric compounds selected from the group consisting of molybdenum, tungsten, and vanadium containing compounds; and (ii) an effective amount of an acid capable of at least partially polymerizing the one or more monomeric compounds; (b) one or more dispersing agents and (c) a diluent oil to form a micro emulsion; and, heating the micro emulsion to a temperature to remove sufficient water so as to produce a stable colloidal suspension comprising (a) a dispersed phase comprising a major amount of one or more dispersed hydrated polymeric compounds selected from the group consisting of polymolybdates, polytungstates and polyvanadates; and, (b) an oil phase comprising the dispersing agent and the diluent oil.

Still yet another embodiment of the present invention, a process for preparing a stable colloidal suspension is provided comprising:

mixing, under agitation, (a) an aqueous solution comprising one or more monomeric compounds selected from the group consisting of niobium, tantalum, and uranium containing compounds; (b) one or more dispersing agents and (c) a diluent oil to form a micro emulsion; and, heating the micro emulsion to a temperature to remove sufficient water so as to produce a stable colloidal suspension comprising (a) a dispersed phase comprising a major amount of one or more dispersed hydrated polymeric compounds selected from the group consisting of polyniobates, polytantalates, and polyuranates and (b) an oil phase comprising the dispersing agent and the diluent oil.

Yet another embodiment of the present invention is a lubricating oil composition comprising (a) a major amount of an oil of lubricating viscosity and (b) a minor effective amount of the foregoing stable colloidal suspensions.

The stable colloidal suspensions herein advantageously exhibit good frictional properties, oxidation inhibition and anti-wear performance when employed as a lubricating additive for lubricating oil compositions. Additionally, the stable colloidal suspensions herein possess low color.

DETAILED DESCRIPTION OF THE PREFERRED EMBODIMENTS

The stable colloidal suspension of the present invention may be generally characterized as comprising (a) a dispersed phase comprising a major amount of one or more dispersed hydrated polymeric compounds selected from the group consisting of polymolybdates, polytungstates, polyvanadates, polyniobates, polytantalates, polyuranates, and mixtures thereof; and, (b) an oil phase comprising one or more dispersing agents and a diluent oil.

Each of these components in the colloidal suspension will be defined herein.

The Dispersed Hydrated Polymeric Compounds

Hydrated polymeric compounds useful in forming the dispersed hydrated polymeric compounds of the dispersed phase of the colloidal suspensions of the present invention are hydrated polymeric compounds selected from the group consisting of polymolybdates, polytungstates, polyvanadates, polyniobates, polytantalates, polyuranates, and mixtures thereof. Generally, formation of the hydrated polymeric compounds is achieved by at least dissolving one or more monomeric compounds selected from the group consisting of molybdenum, tungsten, vanadium, niobium, tantalum, and uranium containing compounds in a suitable medium, e.g., water, to form a solution. Suitable molybdenum, tungsten, vanadium, niobium, tantalum, and uranium containing compounds include can be the simple oxides of such compounds. For example, the simple oxides of molybdenum and tungsten may have the following chemical formulae: $MoO_3$, $WO_3$, $Mo_2O_5$, $MoO_2$, and $WO_2$. It is also contemplated that known other non-stoichiometric oxides can be used herein. For example, the so-called "blue oxides" of molybdenum and tungsten are examples of such non-stoichiometric oxides, and they contain both oxide and hydroxide groups. Although less is known about the oxides and/or hydroxides of vanadium, niobium, tantalum, and uranium, the chemistry is similar and such compounds can be used herein.

In general, when dissolving the one or more molybdenum, tungsten, vanadium, niobium, tantalum, and uranium containing compounds, it is particularly advantageous to employ a strong base such as, for example, hydroxides of alkali metal and alkaline earth metals, ammonium, thallium, etc. While all of the hydroxides of alkali metal, ammonium, magnesium, and thallium form water soluble compounds with the molybdenum, tungsten, vanadium, niobium, tantalum, and uranium containing compounds, other metal hydroxides such as, e.g., calcium, form water insoluble compounds with the molybdenum, tungsten, vanadium, niobium, tantalum, and uranium containing compounds. Accordingly, it may be necessary to add a sufficient amount of an acid effective to dissolve the water-insoluble metal hydroxide and molybdenum, tungsten, vanadium, niobium, tantalum, and uranium containing compounds. Water soluble compounds are preferred herein with the sodium, potassium, ammonium, and magnesium hydroxides being most preferred. Alternatively, compounds such as, for example, sodium molybdates, are known and commercially available and can be directly added to the suitable medium.

The molybdenum containing compounds called molybdates, and the tungsten containing compounds called tungstates, have the structures $M_2MoO_4$ and $M_2WO_4$ respectively, where M is the alkali metal, alkaline earth metal, ammonium, magnesium, or thallium. The vanadates, niobates, tantalates, and uranates each behave similarly. The water soluble compounds can be dissolved in a suitable medium, e.g., water, to form a solution. On the other hand, the water-insoluble powders can be dissolved in a suitable acid and water to form a solution.

As one skilled in the art would readily appreciate, the niobium, tantalum, and uranium compounds can be polymerized in basic solution. However, for the molybdenum, tungsten and vanadium containing compounds, polymeric compounds can only be formed in an acid solution, e.g., a solution having a pH of between about 2 and about 7 is preferred, with a pH between about 5 and about 7 being most preferred. Accordingly, it will be necessary to add an effective amount of an acid capable of at least partially polymerizing the molybdenum, tungsten and vanadium containing compounds. Suitable acids include, but are not limited to, nitric acid, nitric oxides, sulfuric acid, sulfur dioxide, sulfur trioxide, carbonic acid, carbon oxides, carbon dioxide, phosphoric acid, phosphorous acid, phosphoric oxides, polyphosphoric acid, polyphosphoric oxides, silicic acid, silicon monoxide, boric acid, boron oxides and the like with nitric acid, sulfuric acid, carbonic acid, phosphoric acid, pyrophosphoric acid, silicic acid, and boric acid being preferred. Generally, the amount of the acids employed in this step can vary widely, e.g., amounts ranging from about 0.1 to about 2 times the stoichiometric quantity required for neutralization and preferably from about 0.8 to about 1.2 times the theoretical amount.

Generally, when the polymeric compound being formed is from a molybdenum compound, these anions are called polymolybdates. The polymolybdates are generally of two types: the isopolymolybdates and their related anions, which contain only molybdenum, oxygen, and hydrogen, and the heteropolymolybdates and their related anions, which contain one or two atoms of another element in addition to the molybdenum, oxygen, and hydrogen. Similar behavior is observed for tungsten, vanadium, niobium, tantalum, and uranium compounds. These compounds will form polytungstates, polyvanadates, polyniobates, polytantalates, and polyuranates. These polymeric compounds are also generally of two types: isopolytungstates and their related anions, isopolyvanadates and their related anions, isopolyniobates and their related anions, isopolytantalates and their related anions, isopolyuranates and their related anions, heteropolytungstates and their related anions, heteropolyvanadates and their related anions, heteropolyniobates and their related anions, heteropolytantalates and their related anions, and heteropolyuranates and their related anions.

The resulting polymeric compounds ordinarily contain a mixture of monomer, dimer, trimer, and higher polymers of the molybdenum, tungsten, vanadium, niobium, tantalum, and uranium containing compounds. The polymeric compounds can consist of polymeric acids in ionized form or in partially protonated form. They can also be hydrated. The ionized polymeric compounds can also be bound with counter ions such as those discussed above (e.g., alkali metals, ammonium ions, magnesium or thallium ions) depending on the base used to dissolve the molybdenum, tungsten, vanadium, niobium, tantalum, and uranium containing compounds. In addition, other salts may be present in the structure of the polymeric compounds that result from the neutralization reaction of the aqueous solution with the acid for the vanadium, molybdenum, and tungsten compounds.

For the heteropolycompounds, one or more additional elements other than the molybdenum, tungsten, vanadium, niobium, tantalum, and uranium containing compounds, oxygen, and hydrogen will be present. The additional element can be, for example, phosphorus, boron, carbon, nitrogen, sulfur, arsenic, silicon, germanium, tin, titanium, zirconium, cerium, thorium, platinum, manganese, lead, nickel, tellurium, iodine, cobalt, aluminum, chromium, iron, rhodium, copper, selenium, and the like. The preferred additional elements are sulfur, boron and phosphorus. These additional elements can be added at any time during the preparation of the polymeric compound. Preferably, these additional elements will be added to the aqueous solution of the molybdenum, tungsten, vanadium, niobium, tantalum, and uranium containing compounds.

Any suitable compound of the additional element can be used in forming the heteropolycompounds such as, for example, the halide, pseudo halide, oxide, or hydroxide. Examples of such suitable compounds include, but are not limited to, boric acid, nitric acid, nitric oxides, sulfuric acid, sulfur dioxide, sulfur trioxide, carbonic acid, carbon oxides, carbon dioxide, phosphoric acid, phosphorous acid, phosphoric oxides, polyphosphoric acid, polyphosphoric oxides, silicic acid, silicon monoxide, aluminum oxides, germanium oxides, germanium dioxide, stannic acid, stannic oxides, stannous oxides, zinc oxides, plumbic acid, plumboplumbic oxides, plumbous oxides, titanic acid, titanium monoxide, titanium dioxide and the like. Most preferred of these compounds are boric acid, sulfuric acid and phosphoric acid.

The reaction of the alkali metal hydroxides and the oxides of the molybdenum, tungsten, vanadium, niobium, tantalum, and uranium containing compounds is carried out at suitable temperatures and pressures, e.g., a temperature less than or equal to about 100° C., and preferably from about 10° C. to about 30° C. and at atmospheric pressure, to form a solution. Subatmospheric to superatmospheric pressures can also be used herein. The reaction time for this step is typically in the range of from about 30 seconds to about 1 hour. The oxide is ordinarily added to the hydroxide in an amount ranging from about 0.5 to about 3 times the theoretical amount required for reaction, preferably from about 1 to about 2 times the theoretical quantity of oxide is employed, while the hydroxide is present in an amount ranging from about 0.3 to about 2 times the stoichiometric quantity and preferably about 0.5 to about 1 times the stoichiometric quantity.

The Dispersing Agent

The dispersing agents for use in forming the stable colloidal suspension of the present invention include, but are not limited to, polyalkylene succinic anhydrides, non-nitrogen containing derivatives of a polyalkylene succinic anhydride and a basic nitrogen compound selected from the group consisting of succinimides, carboxylic acid amides, hydrocarbyl monoamines, hydrocarbyl polyamines, Mannich bases, phosphonoamides, thiophosphonamides and phosphoramides, and mixtures thereof. One other such group suitable for use herein as a dispersing agent includes copolymers which contain a carboxylate ester with one or more additional polar function, including amine, amide, imine, imide, hydroxyl, carboxyl, and the like. These products can be prepared by copolymerization of long chain alkyl acrylates or methacrylates with monomers of the above function. Such groups include alkyl methacrylate-vinyl pyrrolidinone copolymers, alkyl methacrylate-dialkylaminoethylmethacrylate copolymers and the like as well as high molecular weight amides and polyamides or esters and polyesters such as tetraethylene pentamine, polyvinyl polystearates and other polystearamides. Preferably, the dispersing agent is a polyalkylene succinic anhydride, non-nitrogen containing derivative of a polyalkylene succinic anhydride or mixtures thereof.

The polyalkylene succinic anhydride dispersing agent is preferably a polyisobutenyl succinic anhydride (PIBSA). The number average molecular weight of the polyalkylene tail in the polyalkylene succinic anhydrides used herein will be at least 350, preferably from about to about 750 to about 3000 and most preferably from about 900 to about 1100.

In one embodiment, a mixture of polyalkylene succinic anhydrides is employed. In this embodiment, the mixture preferably comprises a low molecular weight polyalkylene succinic anhydride component e.g., a polyalkylene succinic anhydride having a number average molecular weight of from about 350 to about 1000, and a high molecular weight polyalkylene succinic anhydride component, e.g., a polyalkylene succinic anhydride having a number average molecular weight of from about 1000 to about 3000. Still more preferably, both the low and high molecular weight components are polyisobutenyl succinic anhydrides. Alternatively, various molecular weights polyalkylene succinic anhydride components can be combined as a dispersant as well as a mixture of the other above referenced dispersants as identified above.

In general, the polyalkylene succinic anhydride is obtained from a reaction product of a polyalkylene such as polyisobutene with maleic anhydride. One can use conventional polyisobutene, or high methylvinylidene polyisobutene in the preparation of such polyalkylene succinic anhydrides. The polyalkylene succinic anhydrides can be prepared using conventional techniques e.g., thermal, chlorination, free radical, acid catalyzed, or any other process in this preparation that is within the purview of one skilled in the art. Examples of suitable polyalkylene succinic anhydrides for use herein are thermal PIBSA (polyisobutenyl succinic anhydride) described in U.S. Pat. No. 3,361,673; chlorinated PIBSA described in U.S. Pat. No. 3,172,892; a mixture of thermal and chlorinated PIBSA described in U.S. Pat. No. 3,912,764; high succinic ratio PIBSA described in U.S. Pat. No. 4,234,435; polyPIBSA described in U.S. Pat. Nos. 5,112,507 and 5,175,225; high succinic ratio polyPIBSA described in U.S. Pat. Nos. 5,565,528 and 5,616,668; free radical PIBSA described in U.S. Pat. Nos. 5,286,799, 5,319,030 and 5,625,004; PIBSA made from high methylvinylidene polybutene described in U.S. Pat. Nos. 4,152,499, 5,137,978 and 5,137,980; high succinic ratio PIBSA made from high methylvinylidene polybutene described in European Patent Application Publication No. EP 355 895; terpolymer PIBSA described in U.S. Pat. No. 5,792,729, sulfonic acid PIBSA described in U.S. Pat. No. 5,777,025 and European Patent Application Publication No. EP 542 380; and purified PIBSA described in U.S. Pat. No. 5,523,417 and European Patent Application Publication No. EP 602 863, the contents of each of these references being incorporated herein by reference.

Non-nitrogen containing derivatives of polyalkylene succinic anhydrides include, but are not limited to, succinic acids, Group I and/or Group II mono- or di-metal salts of succinic acids, succinate esters formed by the reaction of a polyalkylene succinic anhydride, acid chloride, or other derivatives with an alcohol (e.g., $HOR^1$ wherein $R^1$ is an alkyl group of from 1 to 10 carbon atoms) and the like and mixtures thereof.

If desired, the foregoing polyalkylene succinic anhydrides and/or non-nitrogen-containing derivatives thereof can be post-treated with a wide variety of post-treating reagents. For example, the foregoing polyalkylene succinic anhydride and/or derivatives thereof can be reacted with a cyclic carbonate under conditions sufficient to cause reaction of the cyclic carbonates with a hydroxyl group. The reaction is ordinarily conducted at temperatures ranging from about 0° C. to about 250° C., preferably from about 100° C. to about 200° C. and most preferably from about 50° C. to about 180° C.

The reaction may be conducted neat, wherein both the polyalkylene succinic anhydride or non-nitrogen containing derivative of a polyalkylene succinic anhydride dispersant and the cyclic carbonate are combined in the proper ratio, either alone or in the present of a catalyst (e.g., an acidic, basic or Lewis acid catalyst). Examples of suitable catalysts include, but are not limited to, phosphoric acid, boron trifluoride, alkyl or aryl sulfonic acid, alkali or alkaline carbonate. The same solvents or diluents as described above with respect to the preparing the polyalkylene succinic anhydride may also be used in the cyclic carbonate post-treatment.

A particularly preferred cyclic carbonate for use herein is 1,3-dioxolan-2-one (ethylene carbonate).

The basic nitrogen compound used to prepare the colloidal suspensions of the present invention must contain basic nitrogen as measured by ASTM D664 test or D2896. It is preferably oil-soluble. The basic nitrogen compounds are selected from the group consisting of succinimides, polysuccinimides, carboxylic acid amides, hydrocarbyl monoamines, hydrocarbon polyamines, Mannich bases, phosphoramides, thiophosphoramides, phosphonamides, dispersant viscosity index improvers, and mixtures thereof. These basic nitrogen-containing compounds are described below (keeping in mind the reservation that each must have at least one basic nitrogen). Any of the nitrogen-containing compositions may be post-treated with, e.g., boron, using procedures well known in the art so long as the compositions continue to contain basic nitrogen. These post-treatments are particularly applicable to succinimides and Mannich base compositions.

The succinimides and polysuccinimides that can be used to prepare the colloidal suspension of the present invention are disclosed in numerous references and are well known in the art. Certain fundamental types of succinimides and the related materials encompassed by the term of art "succinimide" are taught in U.S. Pat. Nos. 3,219,666; 3,172,892; and 3,272,746, the contents of which are incorporated by reference herein. The term "succinimide" is understood in the art to include many of the amide, imide, and amidine species which may also be formed. The predominant product, however, is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetramine, tetraethylene pentamine, and higher molecular weight polyethylene amines. Particularly preferred are those succinimides prepared from polyisobutenyl succinic anhydride of 70 to 128 carbon atoms and tetraethylene pentamine or higher molecular weight polyethylene amines or mixtures of polyethylene amines such that the average molecular weight of the mixture is about 205 Daltons.

Also included within the term "succinimide" are the co-oligomers of a hydrocarbyl succinic acid or anhydride and a polysecondary amine containing at least one tertiary amino nitrogen in addition to two or more secondary amino groups. Ordinarily, this composition has between 1,500 and 50,000 average molecular weight. A typical compound would be that prepared by reacting polyisobutenyl succinic anhydride and ethylene dipiperazine.

If desired, the foregoing succinimides and polysuccinimides can be post-treated with a wide variety of post-treating reagents, e.g., with a cyclic carbonate. The resulting post-treated product has one or more nitrogens of the polyamino moiety substituted with a hydroxy hydrocarbyl oxycarbonyl, a hydroxy poly(oxyalkylene) oxycarbonyl, a hydroxyalkylene, hydroxyalkylenepoly(oxyalkylene), or mixture thereof.

The cyclic carbonate post-treatment is ordinarily conducted under conditions sufficient to cause reaction of the cyclic carbonate with secondary amino groups of the polyamino substituents. The reaction is ordinarily conducted at temperatures ranging from about preferably from about 0° C. to about 250° C. and preferably from 100° C. to about 200° C. Generally, best results are obtained at temperatures of from about 150° C. to 180° C.

The reaction may be conducted neat, and may or may not be conducted in the presence of a catalyst (such as an acidic, basic or Lewis acid catalyst). Depending on the viscosity of the reactants, it may be desirable to conduct the reaction using an inert organic solvent or diluent, e.g., toluene or xylene. Examples of suitable catalysts include phosphoric acid, boron trifluoride, alkyl or aryl sulfonic acid, and alkali or alkaline earth carbonate.

A particularly preferred cyclic carbonate is 1,3-dioxolan-2-one (ethylene carbonate) because it affords excellent results and also because it is readily available commercially.

The molar charge of cyclic carbonate employed in the post-treatment reaction is preferably based upon the theoretical number of basic nitrogen atoms contained in the polyamino substitutent of the succinimide. Thus, when one equivalent of tetraethylene pentamine is reacted with two equivalents of succinic anhydride, the resulting bis-succinimide will theoretically contain three basic nitrogen atoms. Accordingly, a molar charge ratio of 2 would require that two moles of cyclic carbonate be added for each basic nitrogen, or in this case 6 moles of cyclic carbonate for each mole equivalent of succinimide. Mole ratios of the cyclic carbonate to the basic amine nitrogen are typically in the range of from about 1:1 to about 4:1; preferably from about 2:1 to about 3:1.

The foregoing succinimides and polysuccinimides, including the post-treated compositions described above, can also be reacted with boric acid or a similar boron compound to form borated dispersants. In addition to boric acid, examples of suitable boron compounds include boron oxides, boron halides and esters of boric acid. Generally, from about 0.1 equivalent to about 1 equivalent of boron compound per equivalent of basic nitrogen or hydroxyl in the compositions of this invention may be employed.

Carboxylic acid amide compounds are also useful nitrogen-containing compounds for preparing the colloidal suspensions of this invention. Typical of such compounds are those disclosed in U.S. Pat. No. 3,405,064, the contents of which are incorporated by reference herein. These compounds are ordinarily prepared by reacting a carboxylic acid or anhydride or ester thereof, having at least 12 to about 350 aliphatic carbon atoms in the principal aliphatic chain and, if desired, having sufficient pendant aliphatic groups to render the molecule oil soluble with an amine or a hydrocarbyl polyamine, such as an ethylene amine, to give a mono or polycarboxylic acid amide. Preferred are those amides prepared from (1) a carboxylic acid of the formula $R^2COOH$, where $R^2$ is $C_{12-20}$alkyl or a mixture of this acid with a polyisobutenyl carboxylic acid in which the polyisobutenyl group contains from 72 to 128 carbon atoms and (2) an ethylene amine, especially triethylene tetramine or tetraethylene pentamine or mixtures thereof.

Another class of useful nitrogen-containing compounds are hydrocarbyl monoamines and hydrocarbyl polyamines, preferably of the type disclosed in U.S. Pat. No. 3,574,576, the contents of which are incorporated by reference herein. The hydrocarbyl group, which is preferably alkyl, or olefinic having one or two sites of unsaturation, usually contains from 9 to 350, preferably from 20 to 200 carbon atoms. Particularly preferred hydrocarbyl polyamines are those which are derived, e.g., by reacting polyisobutenyl chloride and a polyalkylene polyamine, such as an ethylene amine, e.g., ethylene diamine, diethylene triamine, tetraethylene pentamine, 2-aminoethylpiperazine, 1,3-propylene diamine, 1,2-propylenediamine, and the like.

Yet another class of useful nitrogen-containing compounds are the Mannich base compounds. These compounds are prepared from a phenol or $C_{9-200}$ alkylphenol, an aldehyde, such as formaldehyde or formaldehyde precursor such as paraformaldehyde, and an amine compound. The amine may be a mono or polyamine and typical compounds are prepared from an alkylamine, such as methylamine or an ethylene amine, such as, diethylene triamine, or tetraethylene pentamine, and the like. The phenolic material may be sulfurized and preferably is dodecylphenol or a $C_{80-100}$ alkylphenol. Typical Mannich bases which can be used in this invention are disclosed in U.S. Pat. Nos. 3,539,663, 3,649,229; 3,368,972 and 4,157,309, the contents of which are incorporated by reference herein. U.S. Pat. No. 3,539,663 discloses Mannich bases prepared by reacting an alkylphenol having at least 50 carbon atoms, preferably 50 to 200 carbon atoms with formaldehyde and an alkylene polyamine $HN(ANH)_nH$ where A is a saturated divalent alkyl hydrocarbon of 2 to 6 carbon atoms and n is 1-10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the compound.

Still yet another class of useful nitrogen-containing compounds are the phosphoramides and phosphonamides such as those disclosed in U.S. Pat. Nos. 3,909,430 and 3,968,157, the contents of which are incorporated by reference herein. These compounds may be prepared by forming a phosphorus compound having at least one P—N bond. They can be prepared, for example, by reacting phosphorus oxychloride with a hydrocarbyl diol in the presence of a monoamine or by reacting phosphorus oxychloride with a difunctional secondary amine and a mono-functional amine. Thiophosphoramides can be prepared by reacting an unsaturated hydrocarbon compound containing from 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and a nitrogen-containing compound as defined above, particularly an alkylamine, alkyldiamine, alkylpolyamine, or an alkyleneamine, such as ethylene diamine, diethylenetriamine, triethylenetetramine, tetraethylenepentamine, and the like.

Another class of useful nitrogen-containing compounds includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more co-monomers such as alicyclic or aliphatic olefins or diolefins. The functionalization may be carried out by a variety of processes which introduce a reactive site or sites which usually has at least one oxygen atom on the polymer. The polymer is then contacted with a nitrogen-containing source to introduce nitrogen-containing functional groups on the polymer backbone. Commonly used nitrogen sources include any basic nitrogen compound especially those nitrogen-containing compounds and compositions described herein. Preferred nitrogen sources are alkylene amines, such as ethylene amines, alkyl amines, and Mannich bases.

The Detergent

If desired, a detergent can also be added to the colloidal suspension of the present invention. Suitable detergents for use herein include, but are not limited to, phenates (high overbased or low overbased), high overbased phenate stearates, phenolates, salicylates, phosphonates, thiophosphonates, ionic surfactants and sulfonates and the like with sulfonates being preferred and with low overbased metal sulfonates and neutral metal sulfonates being most preferred. Low overbased metal sulfonates typically have a total base number (TBN) of from about 0 to about 30 and preferably from about 10 to about 25. Low overbased metal sulfonates and neutral metal sulfonates are well known in the art.

The low overbased or neutral metal sulfonate detergent is preferably a low overbased or neutral alkali or alkaline earth metal salt of a hydrocarbyl sulfonic acid having from about 15 to about 200 carbon atoms. The term "metal sulfonate" as used herein is intended to encompass at least the salts of sulfonic acids derived from petroleum products. Such acids are well known in the art and can be obtained by, for example, treating petroleum products with sulfuric acid or sulfur trioxide. The acids obtained therefrom are known as petroleum sulfonic acids and the salts as petroleum sulfonates. Most of the petroleum product which become sulfonated contain an oil-solubilizing hydrocarbon group. Also, the meaning of "metal sulfonate" is intended to encompass the salts of sulfonic acids of synthetic alkyl, alkenyl and alkyl aryl compounds. These acids also are prepared by treating an alkyl, alkenyl or alkyl aryl compound with sulfuric acid or sulfur trioxide with at least one alkyl substituent of the aryl ring being an oil-solubilizing group. The acids obtained therefrom are known as alkyl sulfonic acids, alkenyl sulfonic acids or alkyl aryl sulfonic acids and the salts as alkyl sulfonates, alkenyl sulfonates or alkyl aryl sulfonates.

The acids obtained by sulfonation are converted to metal salts by neutralization with one or more basic reacting alkali or alkaline earth metal compounds to yield Group IA or Group IIA metal sulfonates. Generally, the acids are neutralized with an alkali metal base. Alkaline earth metal salts are obtained from the alkali metal salt by metathesis. Alternatively, the sulfonic acids can be neutralized directly with an alkaline earth metal base. If desired, the sulfonates can then be overbased to produce the low overbased metal sulfonate. The metal compounds useful in making the basic metal salts are generally any Group IA or Group IIA metal compounds (CAS version of the Periodic Table of the Elements). The Group IA metals of the metal compound include alkali metals, e.g., sodium, potassium, lithium. The Group IIA metals of the metal base include the alkaline earth metals such, for example, magnesium, calcium, barium, etc. Preferably the metal compound for use herein is calcium. The metal compounds are ordinarily delivered as metal salts. The anionic portion of the salt can be hydroxyl, oxide, carbonate, borate, nitrate, etc.

The sulfonic acids useful in making the low overbased or neutral salts include the sulfonic and thiosulfonic acids. Generally they are salts of sulfonic acids. The sulfonic acids include, for example, the mono- or polynuclear aromatic or cycloaliphatic compounds. The oil-soluble sulfonates can be represented for the most part by one of the following formulae: $R_2$-T-$(SO_3)_a$ and $R_3$—$(SO_3)_b$, wherein T is a cyclic nucleus such as, for example, benzene, naphthalene, anthracene, diphenylene oxide, diphenylene sulfide, petroleum naphthenes, etc.; $R_2$ is an aliphatic group such as alkyl, alkenyl, alkoxy, alkoxyalkyl, etc.; $(R_2)$+T contains a total of at least about 15 carbon atoms; and $R_3$ is an aliphatic hydrocarbyl group containing at least about 15 carbon atoms. Examples of $R_3$ are alkyl, alkenyl, alkoxyalkyl, carboalkoxyalkyl, etc. Specific examples of $R_3$ are groups derived from petrolatum, saturated and unsaturated paraffin wax, and the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1. In one embodiment, the sulfonic acids have a substituent ($R_2$ or $R_3$) which is derived from one of the above-described polyalkenes.

Illustrative examples of these sulfonic acids include monoeicosanyl-substituted naphthalene sulfonic acids, dodecylbenzene sulfonic acids, didodecylbenzene sulfonic acids, dinonylbenzene sulfonic acids, cetylchlorobenzene sulfonic acids, dilauryl beta-naphthalene sulfonic acids, the sulfonic acid derived by the treatment of polybutene having a number average molecular weight ($M_n$) in the range of about 350 to about 5000, preferably about 800 to about 2000, or about 1500 with chlorosulfonic acid, nitronaphthalene sulfonic acid, paraffin wax sulfonic acid, cetylcyclopentane, sulfonic acid, lauryl-cyclohexane sulfonic acids, polyethylenyl-substituted sulfonic acids derived from polyethylene ($M_n$ of from about 300 to about 1000, and preferably about 750), etc. Normally the aliphatic groups will be alkyl and/or alkenyl groups such that the total number of aliphatic carbons is at least about 8, preferably at least 12 up to about 400 carbon atoms, preferably about 250. Also useful are polyisobutene sulfonates, e.g., those disclosed in U.S. Pat. No. 6,410,491, the contents of which are incorporated by reference herein.

Another group of sulfonic acids are mono-, di-, and tri-alkylated benzene and naphthalene (including hydrogenated forms thereof) sulfonic acids. Illustrative of synthetically produced alkylated benzene and naphthalene sulfonic acids are those containing alkyl substituents having from about 8 to about 30 carbon atoms, preferably about 12 to about 30 carbon atoms, and advantageously about 24 carbon atoms. Such acids include di-isododecylbenzene sulfonic acid, polybutenyl-substituted sulfonic acid, polypropylenyl-substituted sulfonic acids derived from polypropene having an $M_n$ of from about 300 to about 1000 and preferably from about 500 to about 700, cetylchlorobenzene sulfonic acid, di-cetylnaphthalene sulfonic acid, di-lauryldiphenylether sulfonic acid, diisononylbenzene sulfonic acid, di-isooctadecylbenzene sulfonic acid, stearylnaphthalene sulfonic acid, and the like.

Specific examples of oil-soluble sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol mono-sulfide sulfonic acids, dilauryl beta naphthyl sulfonic acids, and alkaryl sulfonic acids such as dodecyl benzene "bottoms" sulfonic acids.

Dodecyl benzene "bottoms" sulfonic acids are the material leftover after the removal of dodecyl benzene sulfonic acids that are used for household detergents. These materials are generally alkylated with higher oligomers. The bottoms may be straight-chain or branched-chain alkylates with a straight-chain dialkylate preferred.

Particularly preferred based on their wide availability are salts of the petroleum sulfonic acid, e.g., those obtained by sulfonating various hydrocarbon fractions such as lubricating oil fraction and extracts rich in aromatics which are obtained by extracting a hydrocarbon oil with a selective solvent, which extract may, if desired, be alkylated before sulfonation by reacting them with olefins or alkyl chlorides by means of an alkylation catalyst; organic polysulfonic acids such as benzene disulfonic acid which may or may not be alkylated; and the like.

Other particularly preferred salts for use herein are alkylated aromatic sulfonic acids in which the alkyl radical or radicals contain at least about 6 carbon atoms and preferably from about 8 to about 22 carbon atoms. Another preferred group of sulfonate starting materials are the aliphatic-substituted cyclic sulfonic acids in which the aliphatic substituent or substituents contain a total of at least 12 carbon atoms such as, for example, alkyl aryl sulfonic acids, alkyl cycloaliphatic sulfonic acids, the alkyl heterocyclic sulfonic acids and aliphatic sulfonic acids in which the aliphatic radical or radicals contain a total of at least 12 carbon atoms. Specific examples of these oil-soluble sulfonic acids include, but are not limited to, petroleum sulfonic acids; petrolatum sulfonic acids; mono- and poly-wax-substituted naphthalene sulfonic acids; substituted sulfonic acids such as cetyl benzene sulfonic acids, cetyl phenyl sulfonic acids and the like; aliphatic sulfonic acids such as paraffin wax sulfonic acids, hydroxy-substituted paraffin wax sulfonic acids and the like; cycloaliphatic sulfonic acids; petroleum naphthalene sulfonic acids; cyclopentyl sulfonic acid; mono- and poly-wax-substituted cyclohexyl sulfonic acids and the like. The expression "petroleum sulfonic acids" as used herein shall be understood to cover all sulfonic acids that are derived directly from petroleum products.

Typical Group IIA metal sulfonates suitable for use herein include, but are not limited to, the metal sulfonates exemplified as follows: calcium white oil benzene sulfonate, barium white oil benzene sulfonate, calcium dipropylene benzene sulfonate, barium dipropylene benzene sulfonate, calcium mahogany petroleum sulfonate, barium mahogany petroleum sulfonate, calcium triacontyl sulfonate, calcium lauryl sulfonate, barium lauryl sulfonate, and the like.

The acidic material used to accomplish the formation of the overbased metal salt can be a liquid such as, for example, formic acid, acetic acid, nitric acid, sulfuric acid, etc, or an inorganic acidic material such as, for example, HCl, $SO_2$, $SO_3$, $CO_2$, $H_2S$, etc, with $CO_2$ being preferred. The amount of acidic material used depends in some respects upon the desired basicity of the product in question and also upon the amount of basic metal compound employed which will vary (in total amount) from about 1 to about 10, preferably from about 1.2 to about 8 and most preferably from about 1.7 to about 6.0 equivalents per equivalent of acid. In the case of an acidic gas, the acidic gas is generally blown below the surface of the reaction mixture that contains additional (i.e., amounts in excess of what is required to convert the acid quantitatively to the metal salt) base. The acidic material employed during this step is used to react with the excess basic metal compound which may be already present or which can be added during this step.

The reaction medium used to prepare the low overbased metal sulfonate or neutral metal sulfonate is typically an inert solvent. Suitable inert solvents that can be employed herein include oils, organic materials which are readily soluble or miscible with oil and the like. Suitable oils include high boiling, high molecular weight oils such as, for example, parrafinic oils having boiling points higher than about 170° C. Commercially available oils of this type known to one skilled in the art include, e.g., those available from such sources as Exxon under the Isopar® tradenames, e.g., Isopar® M, Isopar® G, Isopar® H, and Isopar® V, and the Telura® tradename, e.g., Telura® 407, and Crompton Corporation available as carnation oil. Suitable organic solvents include unsubstituted or substituted aromatic hydrocarbons, ethoxylated long chain alcohols, e.g., those ethoxylated alcohols having up to about 20 carbon atoms, and mixtures thereof Useful unsubstituted or substituted aromatic hydrocarbons include high flash solvent naptha and the like.

If desired, a promoter can also be employed in preparing the low overbased metal sulfonate or neutral metal sulfonate. A promoter is a chemical employed to facilitate the incorporation of metal into the basic metal compositions. Among the chemicals useful as promoters are, for example, water, ammonium hydroxide, organic acids of up to about 8 carbon atoms, nitric acid, sulfuric acid, hydrochloric acid, metal complexing agents such as alkyl salicylaldoxime, and alkali metal hydroxides such as lithium hydroxide, sodium hydroxide and potassium hydroxide, and mono- and polyhydric alcohols of up to about 30 carbon atoms. Examples of the alcohols include methanol, ethanol, isopropanol, dodecanol, behenyl alcohol, ethylene glycol, monomethylether of ethylene glycol, hexamethylene glycol, glycerol, pentaerythritol, benzyl alcohol, phenylethyl alcohol, aminoethanol, cinnamyl alcohol, allyl alcohol, and the like. Especially useful are the monohydric alcohols having up to about 10 carbon atoms and mixtures of methanol with higher monohydric alcohols. Amounts of promoter will ordinarily range from about 0% to about 25%, preferably from about 1.5% to about 20% and most preferably from about 2% to about 16% of acid charge.

In general, the dispersant mixture will ordinarily contain the low overbased metal sulfonate or neutral metal sulfonate in an amount ranging from about 1 to about 20 and preferably from about 5 to about 10 weight percent, based on the total weight of the mixture.

Process for Preparing the Colloidal Suspension

In one embodiment of the present invention, the process for preparing the stable colloidal suspension of the present invention involves mixing, under vigorous agitation, a reaction mixture comprising an aqueous solution containing the foregoing polymeric compounds; and the foregoing dispersing agents, diluent oil and optional detergent to form a micro emulsion and then heating the micro emulsion to a temperature to remove sufficient water so as to produce the stable colloidal suspension of the present invention. If desired, the foregoing dispersing agents and detergents can be added to the aqueous solution as a pre-formed dispersant mixture or each alone can be added, either simultaneously or sequentially. Alternatively, the dispersing agent, diluent oil and optional detergent can be added to the aqueous solution as an oil phase. A diluent oil is used to provide a suitable viscosity such that mixing is adequate to form a stable emulsion having an aqueous phase containing at least the polymeric compounds and an oil phase containing the dispersing agent(s), diluent oil and optionally detergent(s). Suitable diluents are known in the art and commercially available and include, for example, lubricating oil and non-volatile liquid compounds containing only carbon and hydrogen.

In a second embodiment of the present invention, a process for preparing a stable colloidal suspension involves at least mixing, under agitation, (a) an aqueous solution comprising (i) one or more monomeric compounds selected from the group consisting of molybdenum, tungsten, and vanadium containing compounds and (ii) an effective amount of an acid capable of at least partially polymerizing the one or more compounds, (b) one or more dispersing agents, (c) a diluent oil and optionally (d) a detergent to form a micro emulsion and then heating the micro emulsion to a temperature to remove sufficient water so as to produce the stable colloidal suspension of the present invention.

In yet another embodiment of the present invention, a process for preparing a stable colloidal suspension involves at least mixing, under agitation, (a) an aqueous solution comprising one or more monomeric compounds selected from the group consisting of niobium, tantalum, and uranium containing compounds, (b) one or more dispersing agents, (c) a diluent oil and optionally (d) a detergent to form a micro emulsion and then heating the micro emulsion to a temperature to remove sufficient water so as to produce the stable colloidal suspension of the present invention.

In the microemulsion, the polymeric compound or monomeric molybdenum, tungsten, vanadium, niobium, tantalum, or uranium containing compounds will generally be present in the mixture in an amount ranging from about 5 to about 50 weight percent and preferably from about 10 to about 40 weight percent of the mixture. The dispersing agent is typically present in an amount of from about 1 to about 25 weight percent and preferably from about 5 to about 15 weight percent, the water is present in an amount ranging from about 20 to 60 weight percent, while the diluent oil is present in an amount ranging from about 10 to about 70 weight percent. The detergent, if present, is employed in an amount of from about 1 to about 10 weight percent and preferably from about 2 to about 5 weight percent.

Following the formation of the emulsion, it is particularly advantageous to substantially dehydrate the emulsion by heating to a temperature effective to remove sufficient water to provide a stable colloidal suspension. If desired, the colloidal suspension can be further dehydrated to remove additional water, i.e., an amount of from 0 to about 20 wt. % and preferably from about 5 to about 15 wt. %. However, additional dehydration needs to be carefully controlled in order not to destabilize the colloidal suspension. Accordingly, it is generally advantageous to at least partially dehydrate the product. Dehydration of the emulsion can also assist in polymerizing the molybdenum, tungsten, vanadium, niobium, tantalum, and uranium containing compounds to form the dispersed polymeric compounds.

Dehydration can occur in one step or more than one step including an initial step of water removal that is initiated at a temperature of slightly over 100° C. This initial step is followed by a slow increase in temperature whereupon the turbidity of the emulsion changes from turbid to substantially clear. Accordingly, stable colloidal suspensions will ordinarily have a turbidity of less than about 300 nephelometric turbidity units (ntu) and preferably less than about 100 ntu (Turbidity of the finished oils was measured, neat, at 20° C. using a Hach Ratio Turbidimeter Model: 18900. The turbidimeter was calibrated with 18 and 180 ntu Formazin primary standards). The temperature during the dehydration step will typically not exceed about 200° C. and preferably is between about 105° C. to about 150° C. to provide a low color stable colloidal suspension.

Dehydration may also be carried out under reduced pressure. The pressure may be reduced incrementally to avoid problems with foaming. The reaction time sufficient to dehydrate the emulsion and form a stable colloidal suspension can vary widely, e.g., in the range of from about 0.5 to about 3 hours and preferably from about 0.75 to about 1.5 hours. The resulting colloidal suspension will ordinarily contain a dispersed phase and an oil phase containing at least one or more dispersing agents and a diluent oil. The dispersed phase will normally contain at least a major amount of the dispersed hydrated polymeric compounds, e.g., about 50 wt. % to about 100 wt. % and preferably from about 60 wt. % to about 95 wt. % and an oil phase containing at least one or more dispersing agents and a diluent oil.

The colloidal suspension will have a dispersed phase content ranging from about 5 to about 60 and preferably from about 10 to about 50 weight percent of the suspension. The dispersed hydrated polymeric compound particles generally possess a mean particle size of less than about 1 micron and preferably from about 0.01 microns to about 0.5 microns.

Generally, the dehydration of the emulsion is carefully controlled (i.e. using a slow dehydration rate, employing a sweep gas, and the like) in order to avoid condensation of water on the walls of the reaction chamber. Condensation can result in water droplets that contaminate the composition which, in turn, can lead to undesired precipitate formation. Such precipitate formation typically results in large particles that fall from suspension and have deleterious properties.

The Lubricating Oil Composition

The stable colloidal suspensions of the present invention are particularly useful as anti-wear agents when used in lubricating oil compositions. The lubricant composition of the present invention comprises a major amount of an oil of lubricating viscosity and a minor amount of the stable colloidal suspensions of the present invention. The lubricating oil compositions containing the stable colloidal suspensions of this invention can be prepared by admixing, by conventional techniques, the appropriate amount of the stable colloidal suspensions with a suitable lubricating oil. The selection of the particular lubricating oil depends on the contemplated application of the lubricant and the presence of other additives.

The lubricating oil compositions of the present invention ordinarily contain a major amount of an oil of lubricating viscosity and a minor effective amount of the foregoing stable colloidal suspensions. The oils of lubricating viscosity are ordinarily present in an amount ranging from about 30 to about 70 weight percent and more preferably from about 45 to about 55 weight percent of the lubricating oil composition and the stable colloidal suspensions will be present in the lubricating oil compositions in an amount ranging from about 0.1 wt. % to about 10 wt. % and preferably from about 0.5 wt. % to about 2.5% wt. %, based on the total weight of the composition.

The lubricating oil which may be used in this invention includes a wide variety of hydrocarbon oils, such as naphthenic bases, paraffin bases and mixed base oils as well as synthetic oils such as esters and the like. The lubricating oils may be used individually or in combination and generally have viscosity which ranges from 50 to 5,000 Saybolt Universal Seconds (SUS) and usually from 100 to 15,000 SUS at 40° C.

The lubricating oil employed may be any of a wide variety of oils of lubricating viscosity. The base oil of lubricating viscosity used in such compositions may be mineral oils or synthetic oils. A base oil having a viscosity of at least about 2.5 centistokes (cSt) at 40° C. and a pour point below about 20° C., preferably at or below about 0° C. is desirable. The base oils may be derived from natural or synthetic sources. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having the desired viscosity. Hydrocarbon synthetic oils may include, for example, oils prepared from the polymerization of ethylene or from the polymerization of 1-olefins such as polyalphaolefin or PAO, or from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

Thus, the oil can be a refined paraffin type base oil, a refined naphthenic base oil, or a synthetic hydrocarbon or non-hydrocarbon oil of lubricating viscosity. The oil can also be a mixture of mineral and synthetic oils.

The colloidal suspensions of the present invention (as described herein above) can also be blended to form additive packages comprising such colloidal suspensions. These additive packages typically contain from about 10 to about 75 weight percent of the colloidal suspensions described above and from about 90 to about 15 weight percent of one or more of conventional additives selected from the group consisting of ashless dispersants (about 0-5%), detergents (about 0-2%), sulfurized hydrocarbons (about 0-30%), dialkyl hydrogen phosphates (about 0-10%), zinc dithiophosphates (about 0-20%), dialkyl hydrogen phosphates (about 0-10%), pentaerythritol monooleate (about 0-10%), 2,5-dimercaptothiadiazole (about 0-5%), benzotriazole (about 0-5%), molybdenum sulfide complexes such as those described in U.S. Pat. Nos. 4,263,152 and 4,272,387 (about 0-5%), imidazolines (about 0-10%), and foam inhibitors (about 0-2%) and the like wherein each weight percent is based on the total weight of the additive package.

Fully formulated finished oil compositions of this invention can be formulated from these additive packages upon further blending with an oil of lubricating viscosity. Preferably, the additive package described above is added to an oil of lubricating viscosity in an amount of from about 5 to about 15 weight percent to provide for the finished oil composition wherein the weight percent of the additive package is based on the total weight of the composition. More preferably, added along with the oil of lubricating viscosity is a polymethacrylate viscosity index improver which is included at a level of about 0-12% and/or a pour point depressant at a level of about 0-1%, to form a finished oil wherein the weight percent of each of the viscosity index improver and pour point depressant is based on the total weight of the lubricant composition.

A variety of other additives can be present in lubricating oils of the present invention. Those additives include antioxidants, rust inhibitors, corrosion inhibitors, extreme pressure agents, antifoam agents, other viscosity index improves, other anti-wear agents, and a variety of other well-known additives in the art.

The following non-limiting examples are illustrative of the present invention.

Example 1

Preparation of a Colloidal Suspension Containing Dispersed Hydrated Polymeric Molybdate To a 1 liter glass beaker was added, 58.2 g (0.240 mol) of sodium molybdate dihydrate, 15.21 g (0.246 mol) of boric acid, and 150 g deionized water. The mixture was stirred and quickly formed a homogeneous aqueous solution with gentle heating.

To a 1 liter stainless steel blender flask was added 137.75 g Exxon 150N oil (a Group I base stock), 14.40 g of a low overbased synthetic sulfonate having a Total Base Number (TBN) of 17 mgKOH/g (as measured by ASTM D8296), and 30.00 g of a polyisobutenyl succinic anhydride (PIBSA) having a saponification (SAP) number of 118.6 mgKOH/g (as measured by ASTM D93) and containing 92.8% actives. The components were mixed until a homogeneous solution was formed. The hot aqueous solution was then added to the oil solution, over a time period of about 1 minute, while the oil solution was mixed on a Waring Laboratory blender with the blender speed being slowly increased from 50% to 100% of the "high" setting during the 1 minute period to form an emulsion. The resulting emulsion was then mixed for 30 minutes on the "high" setting.

The emulsion was then partially dehydrated in a 1 liter glass beaker insulated with glass wool by heating the emulsion to a maximum temperature of 105° C. with stirring under a nitrogen sweep until an essentially clear colloidal oil suspension was obtained. The total dehydration time was about 1 hour. Next, a small amount of non-dehydrated emulsion was removed from the oil. The resulting product contained 7.8% Mo by Inductively Coupled Plasma (ICP) and had a TBN of 88 mgKOH/g.

Example 2

Preparation of a Colloidal Suspension Containing Dispersed Hydrated Polymeric Molybdate Using the same general procedure outlined in example 1, a dispersed hydrated sodium molybdate complex (the aqueous phase) was prepared by mixing 80.0 g (0.331 mol) of sodium molybdate dihydrate, 8.1 g (0.083 mol) of 96.8% sulfuric acid and 107.5 g of deionized water. The pH of the aqueous phase was approximately neutral (using a pH test strip). The oil phase was prepared using 119.9 g of Exxon 150N oil, and 50.1 g of PIBSA having a SAP number of 92 mgKOH/g. An emulsion was prepared and partially dehydrated in the same manner as example 1 to form a colloidal suspension. Total heating time was about 1.5 hours to a maximum temperature of 105° C. The resulting product was filtered through anhydrous sodium sulfate; and contained 9.7% Mo and 4.6% Na by ICP.

Example 3

Alternative Preparation of a Colloidal Suspension Containing Dispersed Hydrated Polymeric Molybdate To a 1 liter glass beaker 34.9 g (0.242 mol) of molybdenum oxide, 19.2 g (0.48 mol) of sodium hydroxide, and 150 g deionized water was added and gently heated and stirred to dissolve the reactants, and then 15.2 g (0.246 mol) of boric acid was further added. The mixture quickly formed a slightly turbid aqueous solution with heat and stirring.

To a 1 liter stainless steel blender flask was added 137.75 g Exxon 150N oil (a Group I base stock), 14.40 g of a low overbased synthetic sulfonate having a TBN of 17 mgKOH/g, and 30.00 g of a PIBSA having a SAP number of 118.6 mgKOH/g and containing 92.8% actives. The components were mixed until a homogeneous oil solution was formed. Next, the hot aqueous solution was added to the oil solution, over about 1 minute, while the oil solution was mixed on a Waring Laboratory blender; with the blender speed being slowly increased from 50% to 100% of the "high" setting during the 1 minute period to form an emulsion. The resulting emulsion was then mixed for 30 minutes on the "high" setting.

The emulsion was then partially dehydrated in a 1 liter glass beaker insulated with glass wool by heating the emulsion to a maximum temperature of 104° C. with stirring under a nitrogen sweep until an essentially clear colloidal oil suspension was obtained. The total dehydration time was about 1.5 hours. A small amount of non-dehydrated emulsion was removed from the oil. The product contained 8.0% Mo, 3.6% Na, and 0.88% B by ICP, had a TBN of 86 mgKOH/g, and an average particle size distribution of 0.130 μm as measured using a Horiba LA-920 light scattering particle size analyzer.

Example 4

Extended Dehydration of a Colloidal Suspension Containing Dispersed Hydrated Polymeric Molybdate Using the same general procedure outlined in example 2, a dispersed hydrated sodium molybdate complex was prepared from 81.5 (0.337 mol) of sodium molybdate dihydrate, 16.5 g (0.168 mol) of 96.2% sulfuric acid and 224.7 g of deionized water to form the aqueous phase; and 103.6 g of Exxon 150N oil, 36.7 g of PIBSA having a SAP number of 68.1 mgKOH/g, and 8.1 g of an alkyl benzene sulfonic acid was used in the oil phase. An emulsion was then prepared and dehydrated in a similar manner as example 2. The total heating time was about 3 hours to a maximum temperature of 133° C. Water was removed from the suspension during this period as evidenced by evolution of steam. A clear colloidal oil suspension was obtained after about 1.5 hours heating time to a temperature of 105° C. with the product being hazy both before and after this point. The final product was opaque.

Example 5

Preparation of a Colloidal Suspension Containing Dispersed Hydrated Polymeric Molybdate The preparation of the colloidal suspension described in example 1 was repeated with no significant changes. The resulting product contained 7.6% MO, 3.7% Na, and 0.86% B by ICP, had a TBN of 90 mgKOH/g, and an average particle size distribution of 0.135 μm as measured using a Horiba LA-920 light scattering particle size analyzer.

Example 6

Preparation of a Colloidal Suspension Containing Dispersed Hydrated Polymeric Molybdate The preparation of the colloidal suspension described in example 3 was repeated in essentially the same manner except that 18.45 g of 85% of phosphoric acid was used in place of boric acid. The resulting product contained 7.8% MO, 3.7% Na, and 1.7% P by ICP, had a TBN of 76 mgKOH/g, and an average particle size distribution of 0.129 μm as measured using a Horiba LA-920 light scattering particle size analyzer.

Example 7

Automobile Engine Oil Formulated with Colloidal Suspension of Example 1

A baseline automobile engine oil composition was formed containing a SAE 30W automobile engine oil with 6% of a bis-succinimide dispersant, 25 mM/kg of a synthetic highly overbased calcium sulfonate detergent, 25 mM/kg of a highly overbased calcium phenate detergent, 13 mM/kg of a secondary zinc dialkyl dithiophosphate, and 5 ppm of a foam inhibitor. The colloidal suspension of example 1 was formulated into this baseline automobile engine oil composition at 1 weight percent such that the Mo concentration was 0.078%.

Comparative Example A

Automobile Engine Oil Formulated with Molybdenum Sulfide Complex

A baseline automobile engine oil composition was formed containing the same base oil, additives and treat rate as described in Example 7. A commercially available molybdenum sulfide complex as prepared and described in U.S. Pat. Nos. 4,263,152 and 4,272,387 was formulated into this baseline automobile engine oil composition at 1.2% by weight and the Mo concentration was 0.078%.

Color Measurement by ASTM D1500

The automobile engine oils of Example 7 and Comparative Example A were analyzed for color by ASTM D1500. The automobile engine oil of Example 7 measured 3.5 while the automobile engine oil of Comparative Example A measured greater than 8 (off scale by this method). These results demonstrate the preferred low color of the colloidal suspensions of this invention.

Example 8

Low Phosphorus Automobile Engine Oil Formulated with Colloidal Suspension of Example 1

A baseline automobile engine oil composition was formed that contained about 0.05% phosphorus (calculated from ZnDTP concentration). Thus, a SAE 5W-20 automobile engine oil with 3% of a bis-succinimide dispersant, 6 mM/kg of a synthetic low overbased calcium sulfonate detergent, 55 mM/kg of a highly overbased calcium phenate detergent, 7 mM/kg of a secondary zinc dialkyl dithiophosphate, 0.5% of an amine anti-oxidant, 0.2% of a phenolic anti-oxidant and 5% of an ethylene/propylene copolymer viscosity index improver was prepared. The colloidal suspension of example 1 was formulated into this baseline automobile engine oil composition at 1% by weight, and the Mo concentration was 0.078%.

Example 9

Low Phosphorus Automobile Engine Oil Formulated with Colloidal Suspension of Example 2

A baseline automobile engine oil composition was formed containing the same base oil, additives and treat rate as described in Example 8. The colloidal suspension of Example 2 was formulated into this baseline automobile engine oil composition at 1% by weight, and the Mo concentration was 0.097%.

Comparative Example B

Low Phosphorus Automobile Engine Oil

A baseline automobile engine oil composition was formed that contained the same base oil, additives and treat rate as described in Example 8, and no colloidal suspension.

Comparative Example C 0.1% Phosphorus Automobile Engine Oil

A baseline automobile engine oil composition was formed containing the same base oil, additives and treat rate as described in Example 8 except that the 7 mM/kg of a secondary zinc dialkyl dithiophosphate was replaced with 18 mM/kg of the same secondary zinc dialkyl dithiophosphate, and no colloidal suspension.

4-Ball Wear Test

The low phosphorous automobile engine oils of Examples 8 and 9 and Comparative Examples B and C were tested for anti-wear performance using a four ball wear test preformed in a manner similar to ASTM D-4172 (4-ball wear), as follows. These formulated test oils were aged in an oxidation bath, containing steel balls, for 48 hours at 160° C. with 15 L/hour of airflow bubbled through the oil. These aged oils were tested on a 4-ball wear test apparatus using 100C6 steel balls; 90 kg load was applied in 9 stages starting from 10 kg with 10 kg increments at 1500 rotations per minute. The wear index was calculated from movement of the load arm.

The wear test results are set forth below in TABLE 1. Oils with good anti-wear properties exhibit a low wear index in this test.

TABLE 1

4-Ball wear test results

| Sample | 4-Ball Wear Index Result |
|---|---|
| Example 8 | 29 |
| Example 9 | 28 |
| Comparative Example B | 216 |
| Comparative Example C | 24 |

As these data demonstrate, a low phosphorus automobile engine oil having desirable anti-wear properties can be formulated with the colloidal suspensions of this invention.

Example 10

Low Phosphorus Automobile Engine Oil Formulated with Colloidal Suspension of Example 1

A baseline automobile engine oil composition was formed containing a SAE 5W-20 automobile engine oil with 3% of a bis-succinimide dispersant, 6 mM/kg of a synthetic low overbased calcium sulfonate detergent, 55 mM/kg of a highly overbased calcium phenate detergent, 7 mM/kg of a secondary zinc dialkyl dithiophosphate, 0.5% of an amine anti-oxidant, 0.2% of a phenolic anti-oxidant and 5% of an ethylene/propylene copolymer viscosity index improver. The colloidal suspension of example 1 was formulated into this baseline automobile engine oil composition at 1.6% by weight, and the Mo concentration was 0.125%.

4-Ball Load Wear Index Test

The automobile engine oils of Example 10 and Comparative Example B were evaluated for load carrying properties by ASTM D2783. The test measures a load wear index (LWI), reported in kilo-gram force (kgF), a measure of the properties of a lubricant under high pressure conditions. A high LWI is desirable. The load wear index test results are set forth below in TABLE 2.

TABLE 2

| 4-Ball LWI Test Results | |
|---|---|
| Sample | LWI (kgF) |
| Example 10 | 41.7 |
| Comparative B | 30.0 |

The foregoing data further demonstrate the superior performance of the automobile engine oils formulated with the colloidal suspensions of the present invention.

Example 11

Preparation of a Colloidal Suspension Containing Dispersed Hydrated Polymeric Tungstate To a 1-Liter beaker was added 56.1 g (0.242 mol) of Tungsten Oxide, 19.66 g (0.49 mol) of Sodium Hydroxide, and 168.39 g De-ionized water. The mixture was then heated and stirred until all of the solids had gone into solution. Next, 15.17 g (0.245 mol) of Boric Acid was added to the beaker, heated and stirred until dissolved. To a stainless steel Waring lab blending flask was added a dispersant system containing 128.78 g Exxon 150N base oil, 17.02 g of a low overbased synthetic sulfonate with a TBN of 17 mgKOH/g, and 38.97 g of a PIBSA having a SAP number of 118.8 mgKOH/g. The dispersant system was mixed in the blending flask.

Once the system was thoroughly mixed, the heated aqueous solution prepared in the beaker was slowly (over about 1 minute) blended into the flask using a Variac controller to increase the blend speed from 50% to 100% of the Waring Lab blender's "high" setting. The contents of the mixture were then mixed for an additional 30 minutes on the "high setting". Next, the contents of the blending flask were transferred to an insulated 1-Liter Beaker where they were partially dehydrated in the same manner as example 1. A maximum temperature 100° C. was reached over a period of approximately 2 hours. The process yielded a hazy, opaque product which contained 3.45% Sodium and 0.802% Boron by ICP, and had a TBN of 81 mgKOH/g. The average particle size was 0.135 μm as measured using a Horiba LA-920 light scattering particle size analyzer.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A stable colloidal suspension comprising: (a) a dispersed phase comprising a major amount of one or more dispersed hydrated polymeric compounds selected from the group consisting of polymolybdates, polytungstates, polyvanadates, polyniobates, polytantalates, polyuranates, and mixtures thereof; and, (b) an oil phase comprising one or more dispersing agents selected from the group consisting of polyalkylene succinic anhydrides, non-nitrogen containing derivatives of a polyalkylene succinic anhydride selected from the group consisting of a polyalkylene succinic acid, a Group I and/or Group II mono- or di-salt of a polyalkylene succinic acid, a polyalkylene succinate ester formed by the reaction of a polyalkylene succinic anhydride or an acid chloride with an alcohol and mixtures thereof, and mixtures thereof and a diluent oil, wherein the stable colloidal suspension is substantially clear.

2. The colloidal suspension of claim 1, wherein the dispersed hydrated polymeric compound is a dispersed hydrated polymolybdate.

3. The colloidal suspension of claim 1, wherein the polymeric compound further comprises an alkali metal selected from the group consisting of lithium, sodium, potassium and rubidium.

4. The colloidal suspension of claim 3, wherein the alkali metal polymeric compound is sodium polymolybdate.

5. The colloidal suspension of claim 1, wherein the polymeric compound further comprises magnesium, calcium, ammonium or thallium.

6. The colloidal suspension of claim 1, wherein the polymeric compounds are selected from the group consisting of isopolymolybdates, isopolytungstates, isopolyvanadates, isopolyniobates, isopolytantalates, isopolyurantes, heteropolymolybdates, heteropolytungstates, heteropolyvanadates, heteropolyniobates, heteropolytantalates, and heteropolyurantes.

7. The colloidal suspension of claim 1, wherein the major amount of the dispersed hydrated polymeric compounds is from about 50 wt. % to about 100 wt. % of the dispersed phase.

8. The colloidal suspension of claim 1, wherein the major amount of the dispersed hydrated polymeric compounds is from about 60 wt. % to about 95 wt. % of the dispersed phase.

9. The colloidal suspension of claim 1, having a turbidity of less than about 300 nephelometric turbidity units (ntu).

10. The colloidal suspension of claim 1, wherein the dispersed hydrated polymeric compound possesses a mean particle size less than about 1 micron.

11. The colloidal suspension of claim 1, wherein the dispersed hydrated polymeric compound possesses a mean particle size of about 0.01 microns to about 0.5 microns.

12. The colloidal suspension of claim 1, wherein the one or more dispersing agents is a polyisobutylene succinic anhydride.

13. The colloidal suspension of claim 1, wherein the oil phase further comprises a detergent.

14. The colloidal suspension of claim 13, wherein the detergent is a metal sulfonate.

15. The colloidal suspension of claim 14, wherein the metal sulfonate is a low overbased metal or neutral metal sulfonate.

16. The colloidal suspension of claim 14, wherein the metal sulfonate is a calcium sulfonate.

17. A process for preparing a stable colloidal suspension comprising:

mixing, under agitation, (a) an aqueous solution comprising one or more hydrated polymeric compounds selected from the group consisting of polymolybdates, polytungstates, polyvanadates, polyniobates, polytantalates, polyuranates, and mixtures thereof; (b) one or more dispersing agents selected from the group consisting of polyalkylene succinic anhydrides, non-nitrogen containing derivatives of a polyalkylene succinic anhydride selected from the group consisting of a polyalkylene succinic acid, a Group I and/or Group II mono- or di-salt of a polyalkylene succinic acid, a polyalkylene succinate ester formed by the reaction of a polyalkylene succinic anhydride or an acid chloride with an alcohol and mixtures thereof, and mixtures thereof and (c) a diluent oil to form a micro emulsion; and, heating the micro emulsion to a temperature to remove sufficient water so as to produce a stable colloidal suspension comprising (a) a dispersed phase comprising a major amount of one or more dispersed hydrated polymeric compounds selected from the group consisting of polymolybdates, polytungstates, polyvanadates, polyniobates, polytantalates, polyuranates, and mixtures thereof; and, (b) an oil phase comprising the dispersing agent and the diluent oil, wherein the stable colloidal suspension is substantially clear.

18. The process of claim 17, wherein the polymeric compound is a polymolybdate.

19. The process of claim 17, wherein the polymeric compound further comprises an alkali metal selected from the group consisting of lithium, sodium, potassium and rubidium.

20. The process of claim 19, wherein the alkali metal polymeric compound is sodium polymolybdate.

21. The process of claim 17, wherein the polymeric compound further comprises magnesium, calcium, ammonium or thallium.

22. The process of claim 17, wherein the polymeric compounds are selected from the group consisting of isopolymolybdates, isopolytungstates, isopolyvanadates, isopolyniobates, isopolytantalates, isopolyuranates, heteropolymolybdates, heteropolytungstates, heteropolyvanadates, heteropolyniobates, heteropolytantalates, and heteropolyuranates.

23. The process of claim 17, wherein the one or more dispersing agents is a polyisobutylene succinic anhydride.

24. The process of claim 17, wherein the step of mixing, under agitation, further comprises mixing a detergent.

25. The process of claim 24, wherein the detergent is a metal sulfonate.

26. The process of claim 25, wherein the metal sulfonate is a low overbased metal or neutral metal sulfonate.

27. The process of claim 25, wherein the metal sulfonate is a calcium sulfonate.

28. The process of claim 17, wherein the colloidal suspension has a turbidity of less than about 300 ntu.

29. The process of claim 17, wherein the one or more dispersed hydrated polymeric compounds possess a mean particle size less than about 1 micron.

30. The process of claim 17, wherein the one or more dispersed hydrated polymeric compounds possess a mean particle size of about 0.01 microns to about 0.5 microns.

31. The process of claim 17, wherein the major amount of the dispersed hydrated polymeric compounds is from about 50 wt. % to about 100 wt. % of the dispersed phase.

32. The process of claim 17, wherein the major amount of the dispersed hydrated polymeric compounds is from about 60 wt. % to about 95 wt. % of the dispersed phase.

33. A lubricant composition comprising a major amount of an oil of lubricating viscosity and a minor effective amount of the stable colloidal suspension of claim 1.

34. A lubricant composition comprising a major amount of an oil of lubricating viscosity and a minor effective amount of the stable colloidal suspension of claim 4.

35. A lubricant composition comprising a major amount of an oil of lubricating viscosity and a minor effective amount of the stable colloidal suspension of claim 7.

36. A lubricant composition comprising major amount of an oil of lubricating viscosity and a minor effective amount of the stable colloidal suspension of claim 13.

37. An additive package comprising about 10 to about 75 weight percent of the stable colloidal suspension of claim 1.

38. The additive package of claim 37 further comprising one or more of additives selected from the group consisting of ashless dispersants, detergents, sulfurized hydrocarbons, dialkyl hydrogen phosphates, zinc dithiophosphates, polyol esters of fatty acids, 2,5-dimercaptothiadiazole, benzotriazole, molybdenum sulfide complexes, imidazolines, and foam inhibitors.

39. An additive package comprising about 10 to about 75 weight percent of the stable colloidal suspension of claim 7.

40. A process for preparing a stable colloidal suspension comprising:

mixing, under agitation, an (a) aqueous solution comprising (i) one or more monomeric compounds selected from the group consisting of molybdenum, tungsten, and vanadium containing compounds and (ii) an effective amount of an acid capable of at least partially polymerizing the one or more monomeric compounds; (b) one or more dispersing agents selected from the group consisting of polyalkylene succinic anhydrides, non-nitrogen containing derivatives of a polyalkylene succinic anhydride selected from the group consisting of a polyalkylene succinic acid, a Group I and/or Group II mono- or di-salt of a polyalkylene succinic acid, a polyalkylene succinate ester formed by the reaction of a polyalkylene succinic anhydride or an acid chloride with an alcohol and mixtures thereof, and mixtures thereof and (c) a diluent oil to form a micro emulsion; and, heating the micro emulsion to a temperature to remove sufficient water so as to produce a stable colloidal suspension comprising (a) a dispersed phase comprising a major amount of one or more dispersed hydrated polymeric compounds selected from the group consisting of polymolybdates, polytungstates and polyvanadates; and, (b) an oil phase comprising the dispersing agent and the diluent oil, wherein the stable colloidal suspension is substantially clear.

41. The process of claim 40, wherein the monomeric compound is a monomeric molybdenum containing compound.

42. The process of claim 40, wherein the aqueous solution in the step of mixing, under agitation, further comprises a hydroxide selected from the group consisting of alkali metal hydroxides, alkaline earth metal hydroxides, ammonium hydroxide and thallium hydroxide.

43. The process of claim 42, wherein the alkali metal hydroxide is selected from the group consisting of lithium hydroxide, sodium hydroxide, potassium hydroxide and rubidium hydroxide.

44. The process of claim 42, wherein the alkaline earth metal hydroxide is magnesium hydroxide.

45. The process of claim 40, wherein the acid is selected from the group consisting of nitric acid, sulfuric acid, carbonic acid, phosphoric acid, pyrophosphoric acid, silicic acid, boric acid and mixtures thereof.

46. The process of claim 40, wherein the one or more monomeric compounds selected from the group consisting of molybdenum, tungsten, and vanadium containing compounds further comprise an alkali metal.

47. The process of claim 46, wherein the alkali metal is selected from the group consisting of lithium, sodium, potassium and rubidium.

48. The process of claim 40, wherein the dispersed hydrated polymeric compounds are selected from the group consisting of isopolyniobates, isopolytantalates, isopolyuranates, heteropolyniobates, heteropolytantalates, and heteropolyuranates.

49. The process of claim 40, wherein the one or more dispersing agents is a polyisobutylene succinic anhydride.

50. The process of claim 40, wherein the step of mixing, under agitation, further comprises mixing a detergent.

51. The process of claim 50, wherein the detergent is a metal sulfonate.

52. The method of claim 51, wherein the metal sulfonate is a low overbased metal or neutral metal sulfonate.

53. The process of claim 51, wherein the metal sulfonate is a calcium sulfonate.

54. The process of claim 40, wherein the one or more dispersed hydrated polymeric compounds possess a mean particle size less than about 1 micron.

55. The process of claim 40, wherein the one or more dispersed hydrated polymeric compounds possess a mean particle size of about 0.01 microns to about 0.5 microns.

56. The process of claim 40, wherein the major amount of the dispersed hydrated polymeric compounds is from about 50 wt. % to about 100 wt. % of the dispersed phase.

57. The process of claim 40, wherein the major amount of the dispersed hydrated polymeric compounds is from about 60 wt. % to about 95 wt. % of the dispersed phase.

58. The process of claim 40, wherein the colloidal suspension has a turbidity of less than about 300 ntu.

59. A process for preparing a stable colloidal suspension comprising:

mixing, under agitation, (a) an aqueous solution comprising one or more monomeric compounds selected from the group consisting of niobium, tantalum, and uranium containing compounds; (b) one or more dispersing agents and (c) a diluent oil to form a micro emulsion; and, heating the micro emulsion to a temperature to remove sufficient water so as to produce a stable colloidal suspension comprising (a) a dispersed phase comprising a major amount of a dispersed hydrated polymeric compound selected from the group consisting of polyniobates, polytantalates, and polyuranates; and, (b) an oil phase comprising the dispersing agent and the diluent oil, wherein the stable colloidal suspension is substantially clear.

60. The process of claim 59, wherein the aqueous solution in the step of mixing, under agitation, further comprises a hydroxide selected from the group consisting of alkali metal hydroxides, alkaline earth metal hydroxides, ammonium hydroxide and thallium hydroxide.

61. The process of claim 59, wherein the alkali metal hydroxide is selected from the group consisting of lithium hydroxide, sodium hydroxide, potassium hydroxide and rubidium hydroxide.

62. The process of claim 61, wherein the alkaline earth metal hydroxide is magnesium hydroxide.

63. The process of claim 59, wherein the one or more monomeric compounds selected from the group consisting of niobium, tantalum, and uranium containing compounds further comprise an alkali metal.

64. The process of claim 63, wherein the alkali metal is selected from the group consisting of lithium, sodium, potassium and rubidium.

65. The process of claim 59, wherein the one or more dispersed hydrated polymeric compounds are selected from the group consisting of isopolyniobates, isopolytantalates, isopolyuranates, heteropolyniobates, heteropolytantalates, and heteropolyuranates.

66. The process of claim 59, wherein the dispersing agent is selected from the group consisting of polyalkylene succinic anhydrides, non-nitrogen containing derivatives of a polyalkylene succinic anhydride and mixtures thereof.

67. The process of claim 66, wherein the polyalkylene succinic anhydride is a polyisobutylene succinic anhydride.

68. The process of claim 59, wherein in the step of mixing, under agitation further comprises a detergent.

69. The process of claim 68, wherein the detergent is a metal sulfonate.

70. The process of claim 69, wherein the metal sulfonate is a low overbased metal or neutral metal sulfonate.

71. The process of claim 69, wherein the metal sulfonate is a calcium sulfonate.

* * * * *